United States Patent [19]

Kaibara et al.

[11] 3,970,065

[45] July 20, 1976

[54] FUEL INJECTION PUMP CONTROL SYSTEM

[75] Inventors: Nobuhiro Kaibara; Kazuro Nishizawa, both of Higashimatsuyama, Japan

[73] Assignee: Diesel Kiki Co., Ltd., Tokyo, Japan

[22] Filed: June 28, 1974

[21] Appl. No.: 484,151

[30] Foreign Application Priority Data

June 29, 1973 Japan ..... 48-72772

[52] U.S. Cl. ..... 123/140 CC; 123/139 BG; 123/140 MC

[51] Int. Cl.[2] ..... F02D 1/04; F02X 1/06

[58] Field of Search ..... 123/140 CC, 140 MP

[56] References Cited

UNITED STATES PATENTS

| | | | |
|---|---|---|---|
| 3,613,650 | 10/1971 | Stumpp et al. | 123/140 CC |
| 3,766,899 | 10/1973 | Isselhorst | 123/140 CC |
| 3,776,208 | 12/1973 | Stumpp | 123/140 CC |
| 3,850,154 | 11/1974 | Chattopadhayay et al. | 123/140 CC |
| 3,880,125 | 4/1975 | Kammerer et al. | 123/32 EA |

*Primary Examiner*—Wendell E. Burns
*Assistant Examiner*—James W. Cranson, Jr.
*Attorney, Agent, or Firm*—Edwin E. Greigg

[57] ABSTRACT

A control system for a fuel injection pump assembly wherein the regulation of the fuel quantity is influenced by a control rod. This control rod is displaced by a cam follower assembly and the cam itself is a three-dimensional cam whose spatial orientation may be changed, firstly, by rotation about its axis where the magnitude of this rotation depends on the amount of air aspirated by the engine and, secondly, by longitudinal motion along its axis, where the magnitude of this motion depends on the rotational speed of the engine.

3 Claims, 2 Drawing Figures

FUEL INJECTION PUMP CONTROL SYSTEM

BACKGROUND OF THE INVENTION

The present invention relates to a fuel injection pump, especially for use in spark plug ignited internal combustion engines, wherein the injection quantity regulating member (control rod) is actuated by an r.p.m.-dependent centrifugal force governor acting through a lever linkage and via an interposed cam plate element.

In a known fuel injection pump of this type, the cam plate element is a member whose position depends on the position of the accelerator pedal, as well as on the position of the centrifugal weights rotated by the engine. When this known control mechanism is used, however, in low-load operation of the engine, i.e., when the accelerator pedal is only slightly depressed and in a region of low engine r.p.m., the air quantity aspirated by the engine may change without sufficiently precise fuel metering. In addition, the linkage mechanism in that system is also very complicated.

Another known control system in which the pressure within the induction tube is measured by means of a pressure sensor or pick-up system and correspondingly determines the position of the control rod, brings the disadvantage that the sensitivity becomes very poor at full-load operation, i.e., when the difference between the induction tube vacuum and the atmospheric pressure is very small.

OBJECT AND SUMMARY OF THE INVENTION

It is an object of the present invention to provide a fuel injection pumping system which avoids these above-mentioned disadvantages.

This object is attained, according to the invention, in that the cam plate element is embodied as a three-dimensional cam which is set in one spatial direction — preferentially the axial direction — by the centrifugal force governor and in another spatial direction (rotational direction) by an air measuring member located in the induction tube of the internal combustion engine.

This construction results in an increase of the control precision over the entire r.p.m-domain of the engine.

An exemplary embodiment of the object of the invention is represented in the drawing and is described in detail below.

DESCRIPTION OF THE PREFERRED EMBODIMENT

Figure 1:
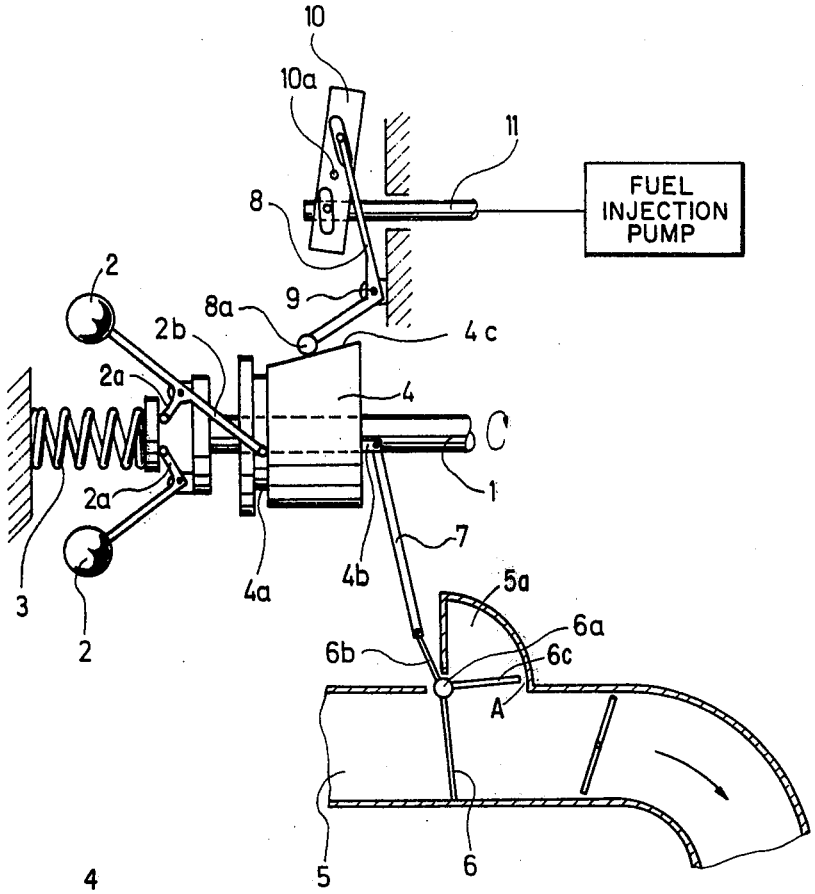
FIG. 1 is a schematic and partly cross-sectional representation of a fuel injection control system according to the invention.
Figure 1A:
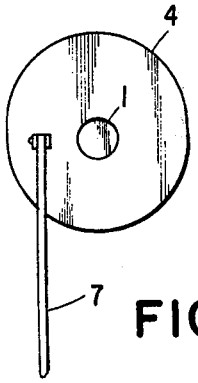
FIG. 1A is an end view of cam 4.

A cam shaft 1 belonging to a fuel injection pump which is not further shown drives a centrifugal force governor with fly weights 2 whose lever arms 2*a* communicate with a control spring 3. The spring 3 acts on the lever arms 2*a* in opposition to the effect of the centrifugal force. The change of position of fly weights 2, caused by the centrifugal force, is transmitted to a three-dimensional cam 4 by an extension rod 2*b* whose one end engages a groove 4*a* provided for this purpose in the three-dimensional cam 4.

An induction tube 5 of the engine (not shown) contains a flap 6 which measures the aspirated air quantity and which is pivotably mounted about an axis 6*a* located outside of the induction tube. An extension 6*b* on the measuring flap 6 is attached to one end of a connecting rod 7 whose other end is attached to a pivot pin 4*b* fastened on the face of the three-dimensional cam 4, in such a manner that the rotary movement of the measuring flap 6 results in a change of the rotational position of three-dimensional cam 4 on the cam shaft 1.

A guide lever 8 is pivotably mounted about a locally fixed axis 9 and has a follower element 8*a* which follows the contour of the cam surface 4*c* of the three-dimensional cam 4. Changes in the spatial orientation of the three-dimensional cam 4 result in changes in the spatial position of the point of contact of the follower element 8*a* on the cam surface 4*c*. These changes are transmitted by guide lever 8 to an intermediate lever 10, pivotable about an axis 10*a*, which displaces control rod 11 controlling the injected fuel quantity.

In the fuel injection system described above, the axial position of the three-dimensional cam 4 is controlled by the r.p.m.-dependent rotational motion of cam shaft 1, causing the centrifugal force-induced position change of the fly weights 2 which is transmitted to the cam 4 by the extension rod 2*b*, whereas the rotation of the three-dimensional cam 4 about the cam shaft 1 is due to the motion of the measuring flap 6 within the induction tube 5, whose degree of opening is determined by the amount of air aspirated through the induction tube and whose rotary motion is transmitted to the cam 4 by the lever 6*b*, the connecting rod 7 and the pivot pin 4*b*. Thus, the degree of rotation of the three-dimensional cam corresponds to the degree of opening of the measuring flap 6, i.e., to the aspirated air quantity. These movements of the three-dimensional cam 4 cause the movement of the guide lever 8 and the intermediate lever 10 which displaces the control rod 11, changing the injected fuel quantity.

Thanks to this construction, the precision of the control process which regulates the injected fuel quantity is increased over the entire r.p.m. domain of the engine. Even in the case where the aspirated air quantity might change, for example, due to the plugged up air filter or because of a general deterioration of the suction system of the engine, for example due to wear in the intake valve, nevertheless the fuel quantity metered out always corresponds to the air quantity actually aspirated by the engine and this fact results in a correspondingly high efficiency and in the required low concentration of toxic or uncombusted components in the exhaust gas.

A damper 6*c*, constructed integrally with the measuring flap 6, is mounted pivotably about the axis 6*a* and in such a manner as to close or block a fan-shaped damper chamber 5*a* provided to the induction tube 5. The free end of the damper 6*c* defines a suitable gap A between itself and the inner wall of said damper chamber 5*a* so that, upon rotation or turning of said damper 6*c*, air is allowed to flow into and out of said damper chamber 5*a*. In this way, said damper 6*c* serves to prevent the occurrence of an overshooting in rotation of the measuring flap 6, which would otherwise tend to take place, when the degree of opening or the pedal position of the accelerator is subjected to a sudden change, so as to cause an excessive fuel supply, thus unbalancing the air fuel ratio.

What is claimed is:

1. In a fuel injection pump assembly, especially one for use in spark-plug ignited internal combustion engines, including a control rod, for regulating the amount of fuel metered out to the engine;

a centrifugal force governor whose rotational speed depends on the r.p.m. of the engine; and a cam element, wherein the centrifugal force governor influences the orientation of the cam element and wherein the orientation of the cam element is transmitted mechanically to said control rod to influence the position thereof, the improvement comprising:

a. an air measuring member located within the induction tube of the engine;

b. first mechanical linkage means connecting said air measuring member to said cam element; and c. second mechanical linkage means connecting said cam element to said centrifugal force governor, wherein said cam element is embodied as a three-dimensional cam capable of motion in at least two degrees of freedom, whereby said three-dimensional cam is displaced in one direction, preferably the axial direction, by said centrifugal force governor via said first mechanical linkage means and is displaced in another direction, preferably in rotation about its own axis, by said air measuring member acting via said second mechanical linkage means to said three-dimensional cam.

2. A fuel injection pump assembly as defined in claim 1, wherein said air measuring member is a flap valve which is rotatable about an axis and which is exposed to the air flow aspirated by the engine.

3. A fuel injection pump assembly as defined in claim 2, further comprising d. damping means, integral with said flap valve, for damping the motion of said flap valve by compression of the air in a portion of the induction tube of the engine during motions of said flap valve.

* * * * *